US010161103B2

(12) United States Patent
Falkenhagen

(10) Patent No.: US 10,161,103 B2
(45) Date of Patent: Dec. 25, 2018

(54) DRAGLINE BUCKET ASSEMBLY

(71) Applicant: The Track Shop Pty Ltd., Cedar Creek (QLD) (AU)

(72) Inventor: Timothy Stuart Falkenhagen, Cedar Creek (AU)

(73) Assignee: THE TRACK SHOP PTY LTD., Cedar Creek (QLD) (AU)

( * ) Notice: Subject to any disclaimer, the term of this patent is extended or adjusted under 35 U.S.C. 154(b) by 0 days.

(21) Appl. No.: 15/280,311

(22) Filed: Sep. 29, 2016

(65) Prior Publication Data

US 2017/0089034 A1 Mar. 30, 2017

(30) Foreign Application Priority Data

Sep. 29, 2015 (AU) ..... 2015903952

(51) Int. Cl.

| | |
|---|---|
| ***E02F 3/60*** | (2006.01) |
| ***E02F 3/46*** | (2006.01) |
| ***E02F 3/48*** | (2006.01) |
| ***E02F 9/28*** | (2006.01) |

(52) U.S. Cl.
CPC ..... *E02F 3/60* (2013.01); *E02F 3/48* (2013.01); *E02F 9/285* (2013.01)

(58) Field of Classification Search
CPC ... E02F 3/48; E02F 3/60; E02F 9/2883; E02F 9/285
USPC ..... 37/398, 397, 399
See application file for complete search history.

(56) References Cited

U.S. PATENT DOCUMENTS

| | | | | |
|---|---|---|---|---|
| 1,879,447 A * | 9/1932 | Page | ..... | E02F 3/60 37/398 |
| 1,986,853 A * | 1/1935 | Rauch | ..... | E02F 3/60 37/398 |
| 2,926,800 A * | 3/1960 | Larsen | ..... | E02F 3/40 219/137 R |
| 5,400,530 A * | 3/1995 | Schmidt | ..... | E02F 3/48 37/396 |
| 6,237,260 B1 * | 5/2001 | Gooch | ..... | E02F 3/60 37/398 |
| 6,834,449 B2 * | 12/2004 | Leslie | ..... | E02F 3/60 37/398 |

* cited by examiner

*Primary Examiner* — Robert E Pezzuto
(74) *Attorney, Agent, or Firm* — Abelman, Frayne & Schwab

(57) ABSTRACT

A dragline bucket assembly including: a cutting edge including a lip and a plurality of teeth or tooth assemblies attachable to the lip and a floor extending rearward from the cutting edge and having side walls extending upward from the periphery of the floor to extend about the floor from one end of the cutting edge to the other, the lip being attachable to the side walls by bolting or by bolting and welding.

4 Claims, 19 Drawing Sheets

DRAGLINE BUCKET ASSEMBLY

CROSS-REFERENCE TO RELATED APPLICATION

This application is related to and claims priority under U.S.C. § 119 to Australian patent application No. 2015903952 filed Sep. 29, 2015, the contents of which are incorporated by reference herein in its entirety.

FIELD OF THE INVENTION

This invention relates to a dragline bucket assembly.

BACKGROUND OF THE INVENTION

Dragline buckets are typically formed as a construction of a number of large metal castings all welded together. Wear protection is normally attached to the heel, lips and jaw sections of the bucket. Such buckets are difficult to transport due to size and weight, and are costly to manufacture and maintain. Moreover, existing dragline buckets cannot easily be adapted to different digging conditions.

SUMMARY OF THE INVENTION

The present invention aims to provide a dragline bucket assembly which alleviates one or more of the shortcomings of the prior art. The invention also aims to provide a dragline bucket assembly which is adaptable to different digging conditions. Other aims and advantages of the invention may become apparent from the following description.

With the foregoing in view, in one aspect the present invention resides broadly in a dragline bucket assembly including:

a cutting edge including a lip and a plurality of teeth or tooth assemblies attachable to the lip;

a floor extending rearward from the cutting edge and having side walls extending upward from the periphery of the floor to extend about the floor from one end of the cutting edge to the other, the lip being attachable to the side walls by bolting or by bolting and welding.

The lip may be attachable by bolting to side walls of the bucket as well as, or instead of, being bolted to the floor. The lip may be in the form of a lip assembly including a capping plate and a bottom plate for retaining a plurality of teeth or tooth assemblies in operative alignment. The operative alignment of the teeth may be selected according to digging conditions for which the bucket is to be used. The lip may also be formed from a plurality of plates having similar form stacked in face-to-face abutting relationship. The lip may include a plurality of crenations into each of which a tooth or tooth assembly may be fixed or fastened.

In another aspect, the present invention resides broadly in a dragline bucket assembly having a floor extending rearward from a cutting edge, a rear wall extending upward from the floor opposite the cutting edge and lateral side walls extending upward from each side of the floor; and wherein the lateral side walls each include a chassis formed as a single piece extending from the cutting edge to the rear wall.

Preferably, the floor and side walls are assembled to form the bucket assembly from flat sheet steel. The chassis may be formed from a plurality of sheets welded together. Preferably, the lip is welded to the floor after bolting to the floor and/or side walls. In order to attach the lip to the side walls, a cheek plate or the like maybe provided, the cheek plate being fixed to the ends of the lip.

Preferably, the rear wall has a main portion attachable to at or near the rear of the floor to extend upwardly therefrom and two side portions extending one from each end of the rear main portion and each being attachable by an end portion to a rear portion of one of the side walls.

Preferably, the end portions of the rear wall extend at substantially right angles to the main portion. Preferably, a curved transition is provided from the main portion to each side portion. In such form, the chassis is attached to the lateral side walls and the end portions of the rear wall.

Preferably, the inside corner where the side walls meet the floor are provided with a curved gusset to prevent build-up of material in the corner, the gusset being provided as a wear part which is replaceable. The gusset may be provided in one or more pieces along the inside corner, fixed or fastened in place by bolting or welding or a combination of bolting and welding.

The plurality of teeth or tooth assemblies are attached to the lip at regularly spaced intervals along the length of the lip to project forward of the floor. It is also preferred that the teeth or tooth assemblies project at a suitable angle downward from the floor. Preferably, the lip assembly is mechanically linked to the lip such that the teeth or tooth assemblies may be removed and replaced. The lip assembly may include a lip shroud or the like for protecting the lip against wear. Preferably, however, the teeth are provided all the way across the cutting edge, obviating the requirement for lip shrouds.

It will be appreciated that the teeth may be provided as single-part teeth, two-part teeth or multi-part teeth, or teeth with an adaptor or the like. In one form, the teeth are provided as a plurality of plates, more preferably having different properties for each plate.

In another aspect, the present invention resides broadly in a laminated tooth assembly including:

a plurality of lip plates of complementary form which may be fastened or welded to one another to provide layers; and a plurality of teeth or tooth assemblies fastened to the lip plates.

Replacement teeth may be inserted, such as by ram or the like, and jacked out for replacement of new teeth if they have become worn or by alternative configuration of teeth for digging in different applications. In another form, the teeth may be formed or welded to a plate to form a lip plate and tooth assembly. In such form, a plurality of lip plate and tooth assemblies may be fastened or welded together to form the cutting edge assembly. It is also preferred that the outer plate or plates be formed from hardwearing material or materials and that the inner plates be formed from material or materials which is more resiliently flexible.

A sloping wall may also be provided intermediate the floor and the rear wall. In such form, the main portion of the rear wall is narrower in height than the end portions which widen out commensurate with the slope of the sloping wall. The sloping wall is attached to the floor forward of the rear of the floor and to the rear wall just above its lower extremity.

Each lateral side wall may include a chassis plate attached along at least some of, and extending at least part way upwardly from, the lower perimeter. In such form, the chassis plates may be welded to a metal plate to fill in the side and form the side walls. The trunnions may be each arranged on, in or in association with an arch plate attached to each chassis plate. In one form, each arch plate is provided in two pieces, a lower piece being attached to the chassis plate and an upper piece being welded to the lower piece and having the trunnion mounted thereto. The arch is completed by providing a bar extending across from one arch plate to the other. A rear arch may also be provided to extend across the top of the bucket just in front of the join between the side portions and of the rear wall and the side walls. It will be appreciated that a curved arch may be provided as an alternative to the plate and bar arrangement herein described, especially where extra height is required above the remainder of the bucket assembly.

The teeth may be formed each as singular, integrally formed tooth, preferably with hardfacing applied to at least part of the surface, or as tooth assemblies made up from a plurality of plates. The tooth or tooth assembly may, for example, be attached directly to the lip assembly or as a two-piece or three-piece construction. In a preferred form, the tooth is provided in the form of a tooth assembly having two or more layers of complementary shape. In a preferred form, the tooth assembly has three tooth layers. It will be appreciated that the options herein described permit variation on the digging angle, position and form and for different materials to be selected to form the layers of the teeth or tooth assemblies.

In this specification, terms such as upward, downward and such like are used to describe bucket assemblies in their normal orientation, and in the case of dragline buckets, in or close to the orientation of the bucket when being pulled by the dragline for filling and are not to be taken as limiting the bucket assemblies to any particular orientation.

BRIEF DESCRIPTION OF THE DRAWINGS

In order that the invention may be more readily understood and put into practical effect, the present invention will now be exemplified and described with reference to the following drawings, and wherein.

Figure 1:
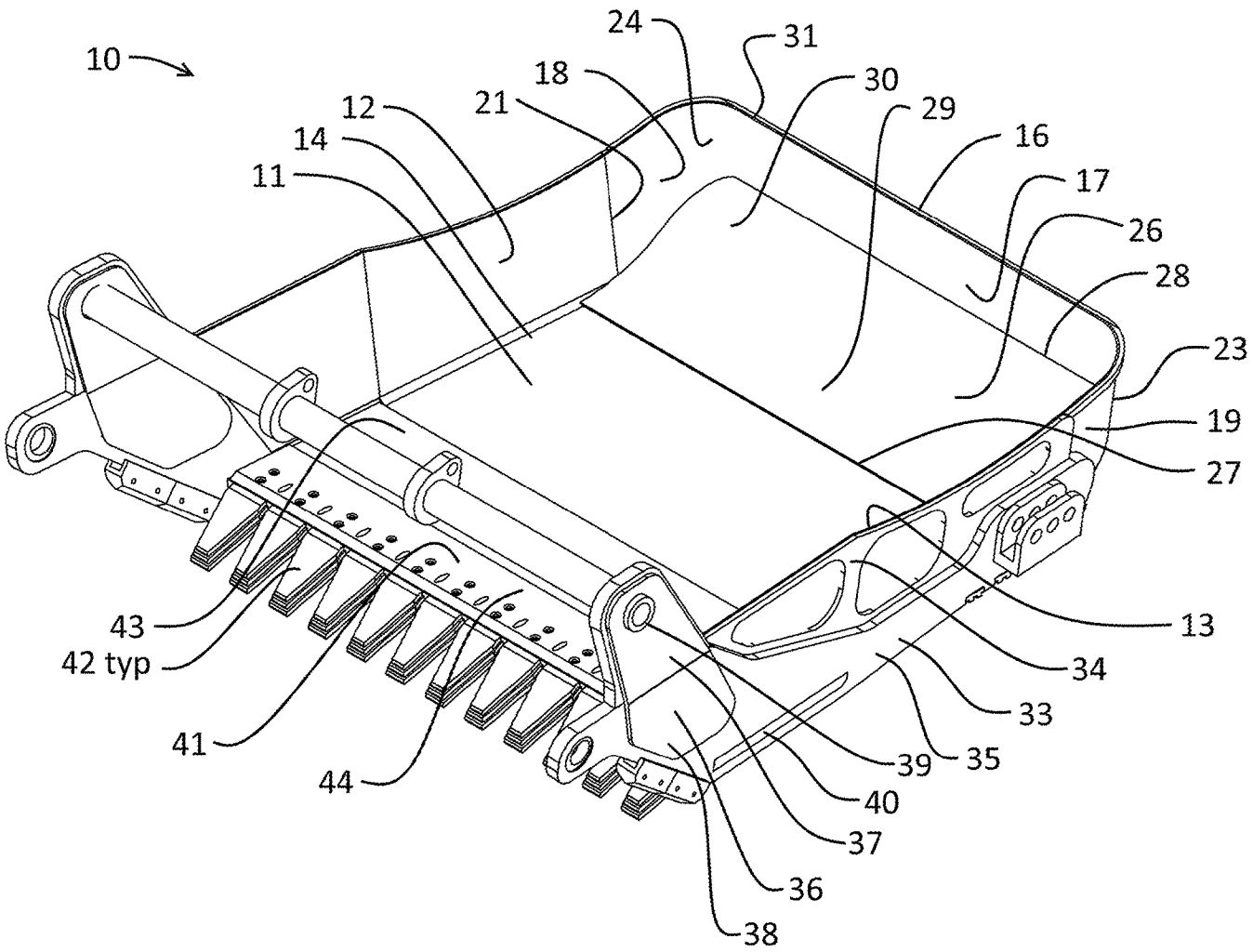
FIG. 1 is a pictorial view of a bucket assembly according to the invention with front arch plates and trunnion welded to side wall chassis.
Figure 2:
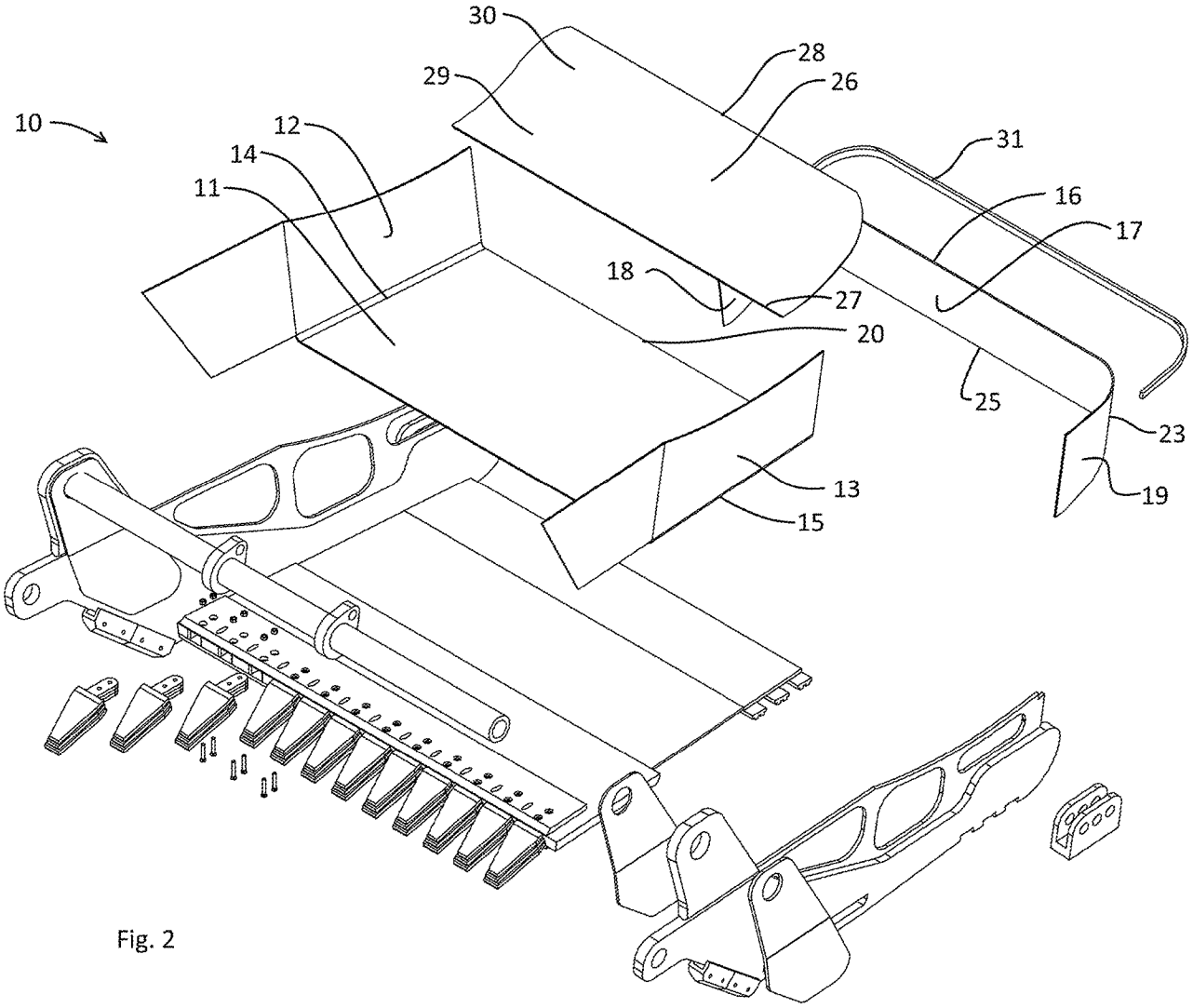
FIG. 2 is an exploded view of the bucket assembly of FIG. 1.
Figure 3:
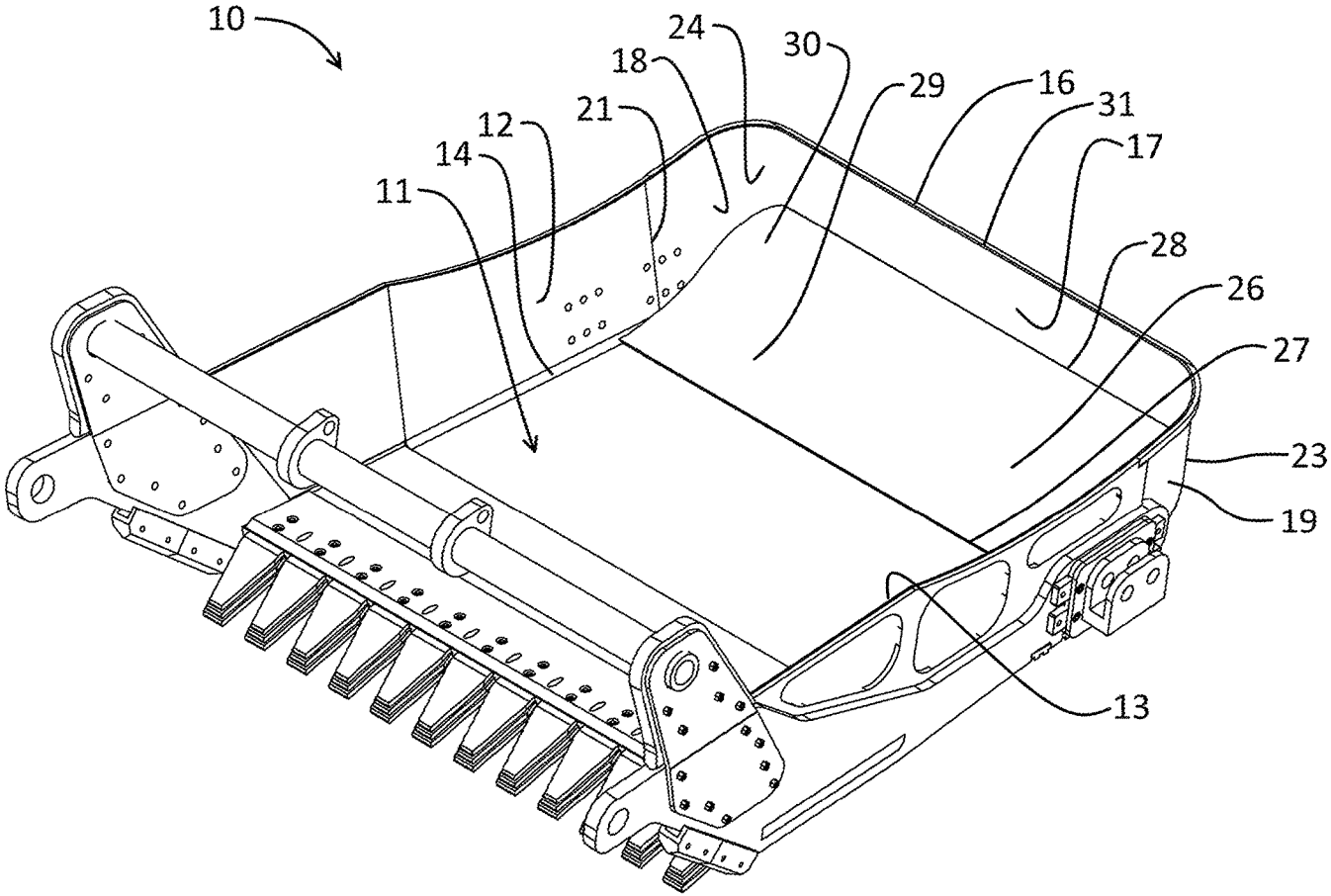
FIG. 3 is a pictorial view of a bucket assembly according to the invention with front arch plates and trunnion bolted to side wall chassis.
Figure 4:
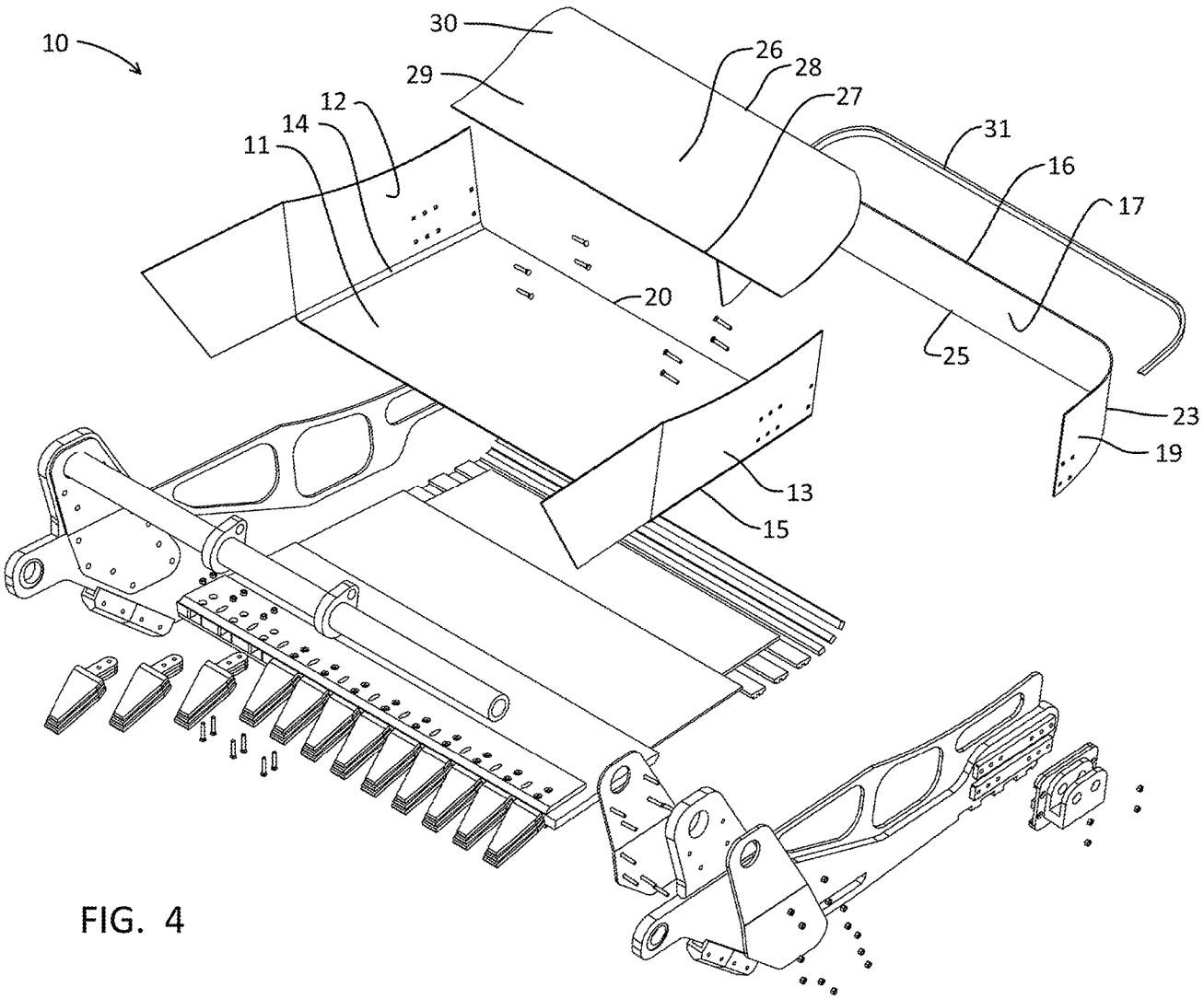
FIG. 4 is an exploded view of the bucket assembly of FIG. 3.
Figure 10:
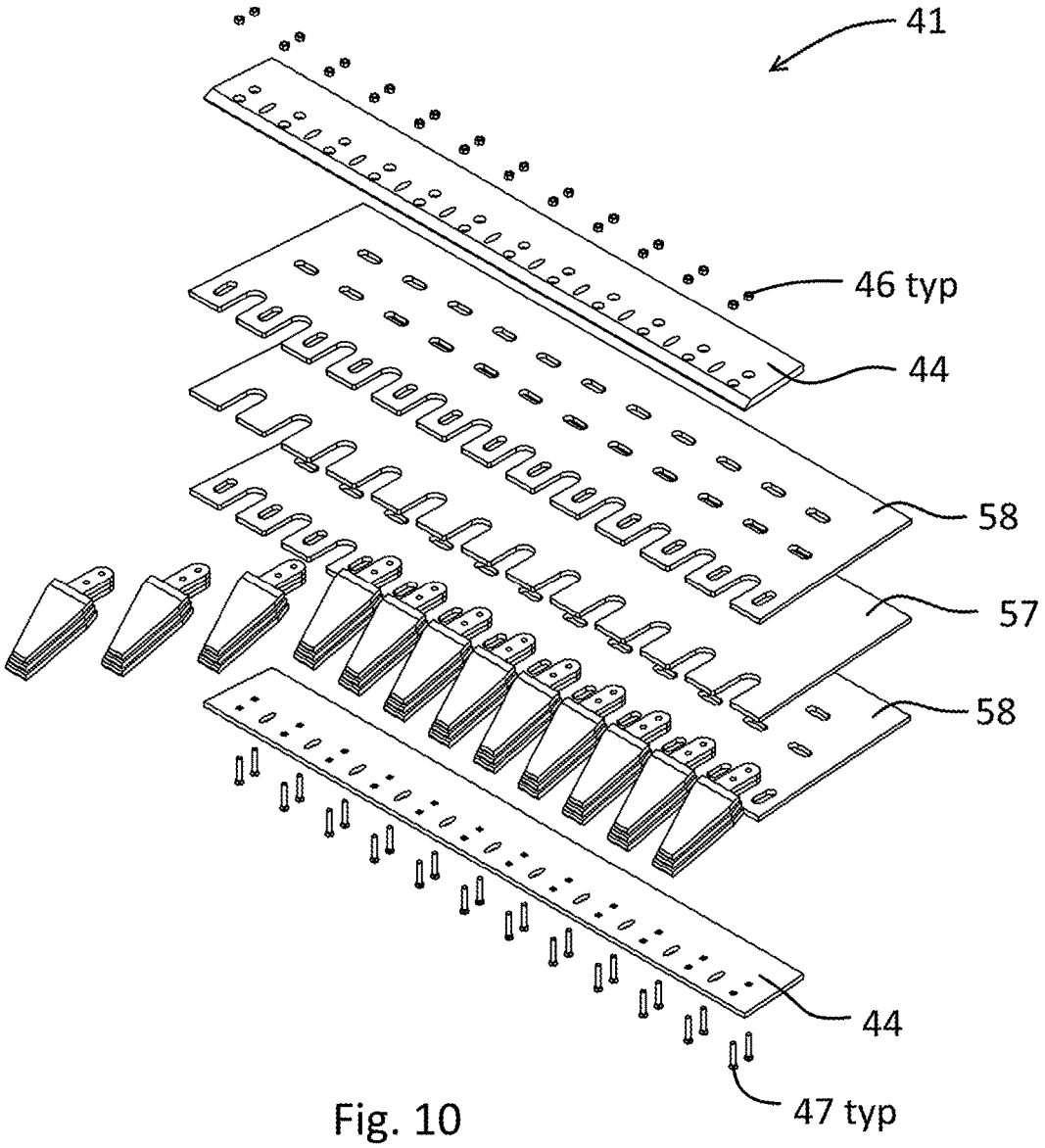
Figure 11:
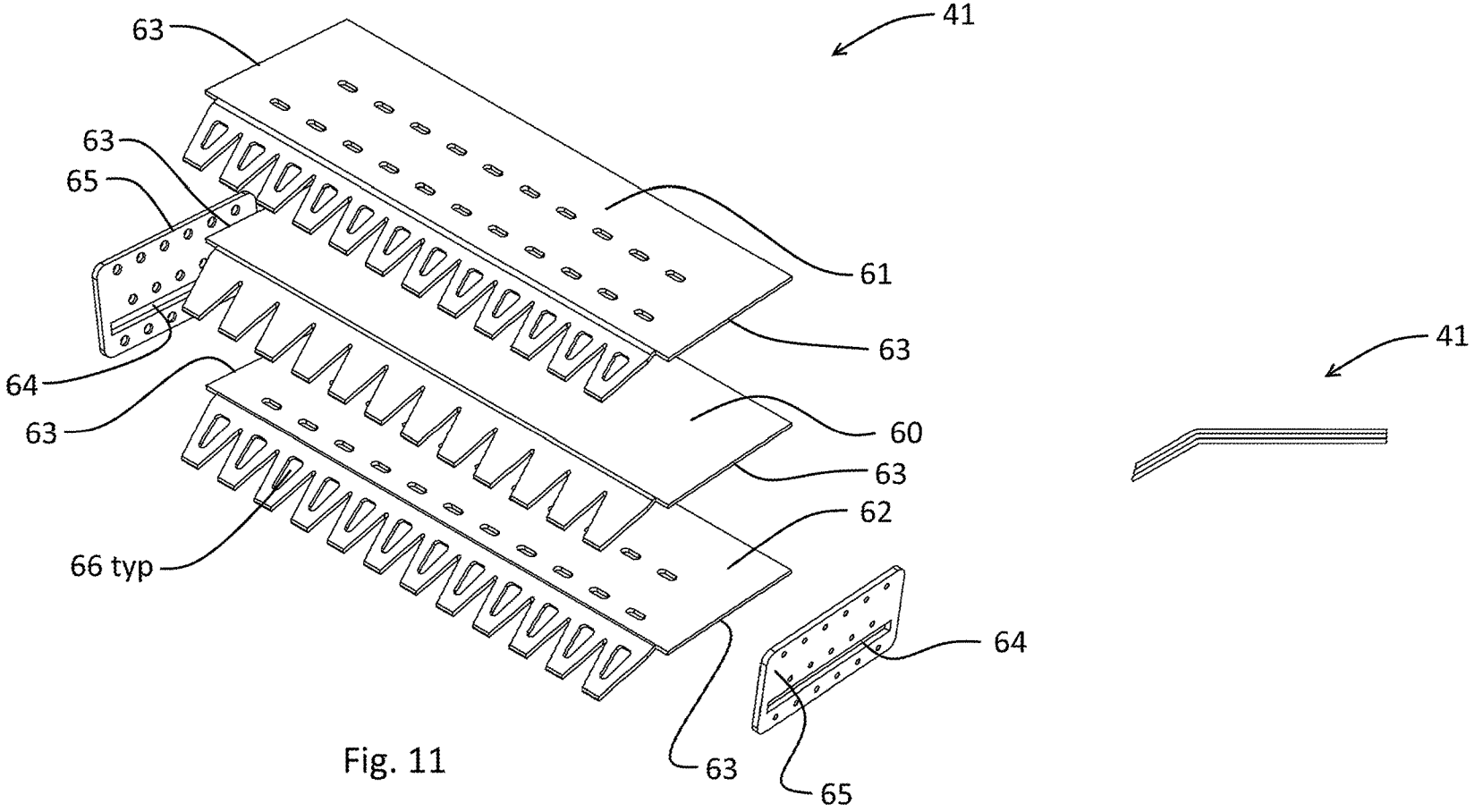
Figure 12:
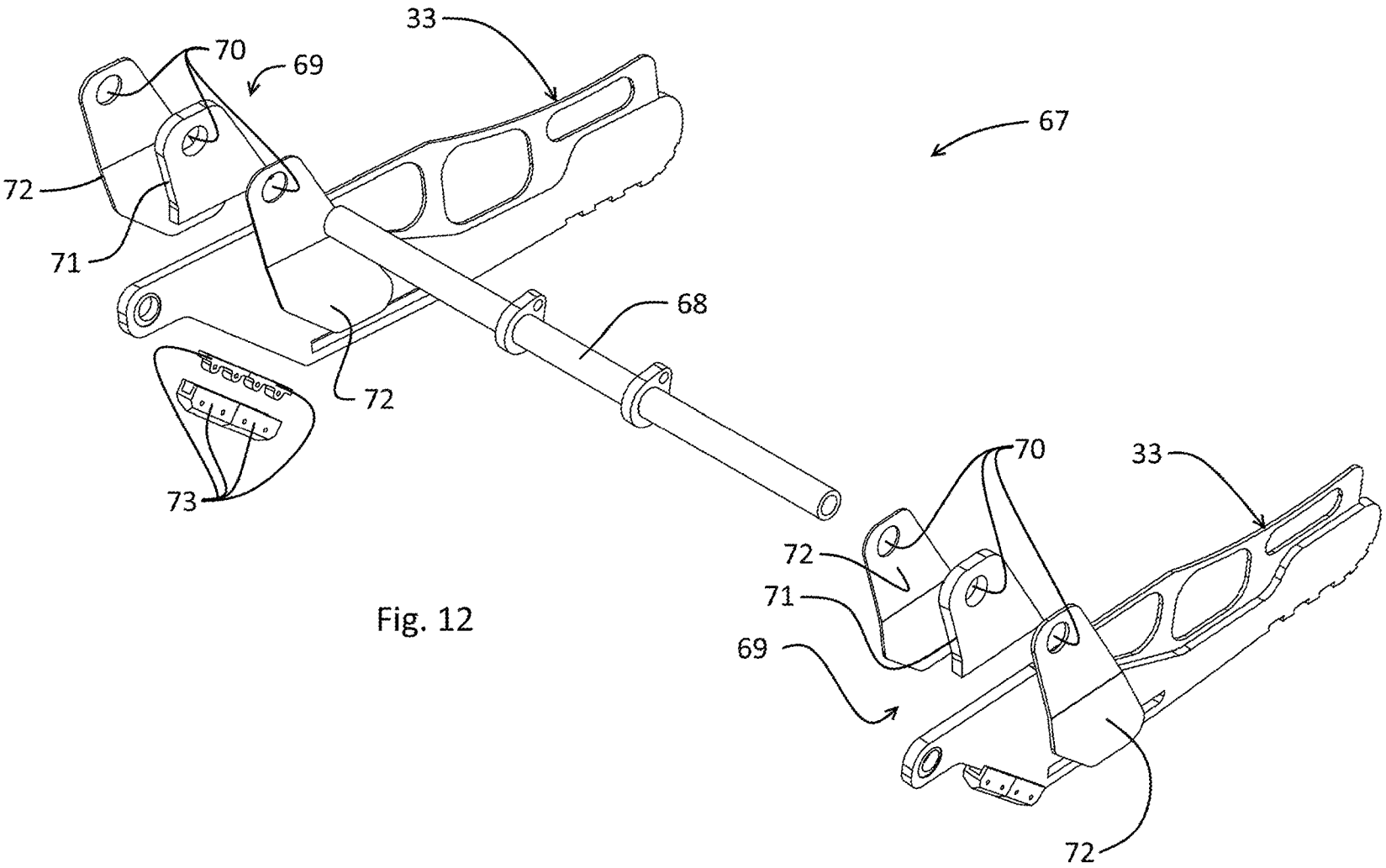
Figure 13:
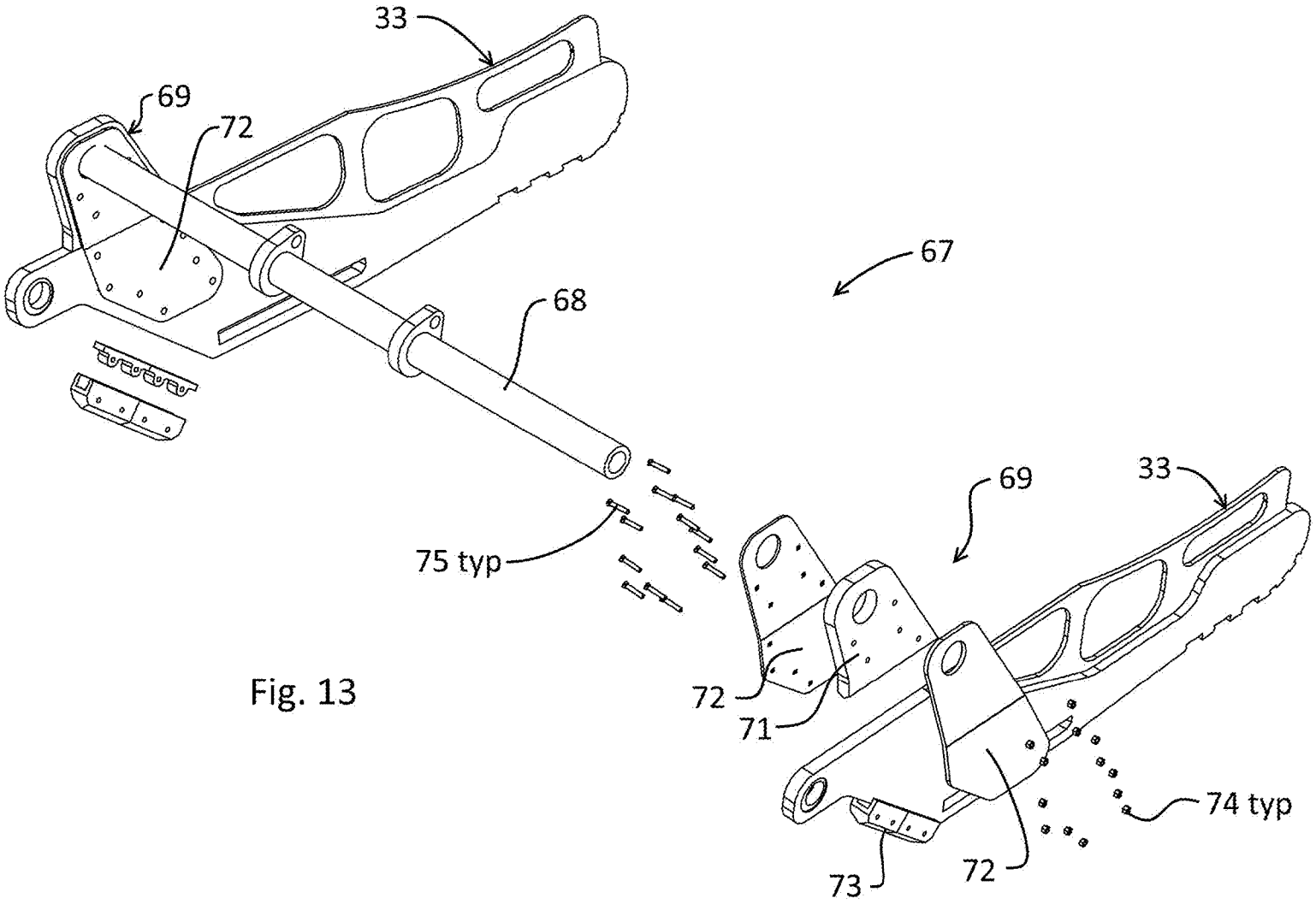
Figure 14:
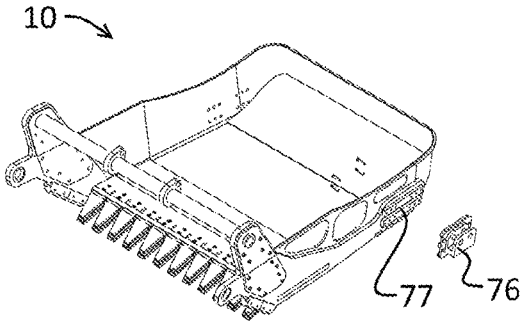
Figure 15:
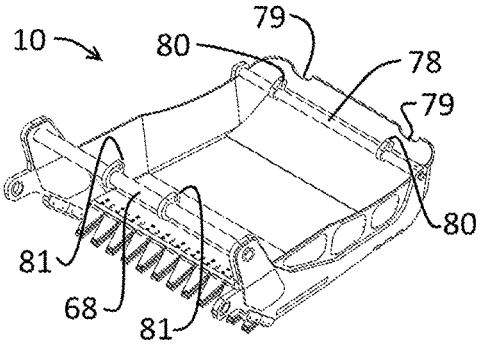
Figure 16:
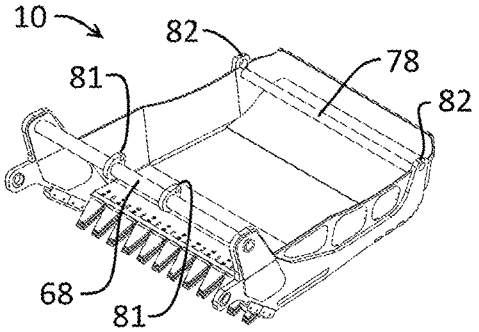
Figure 17:
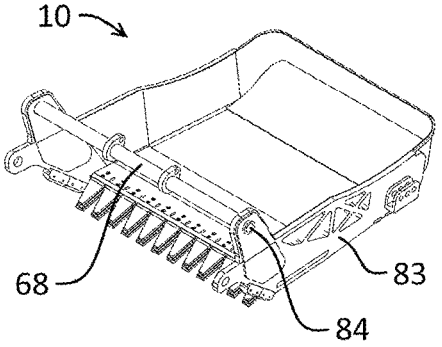
Figure 16A:
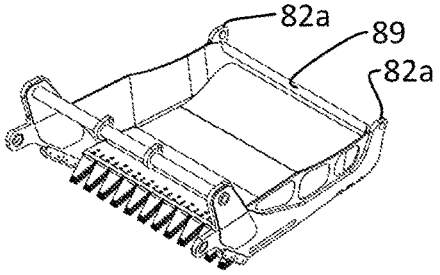
Figure 18:
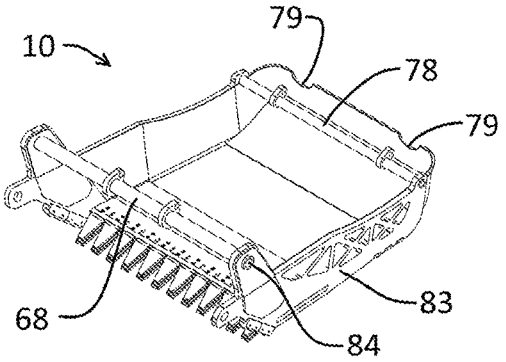
Figure 19:
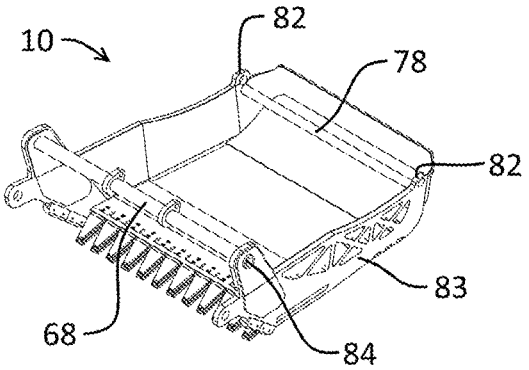

7*a* laminated angled teeth (serrated);

7*b* solid angled teeth (fabricated or cast; serrated);

7*c* solid flat teeth (plate; straight edge—for chop cutting);

8*a* tiger tooth option—2 points per tooth;

8*b* solid angled teeth (plate or cast) with top face shroud;

8*c* laminated angled teeth with top face shroud;

9*a* replaceable tip solid angled tooth, fabricated or cast, with cast tip;

9*b* replaceable tip laminated angled tooth with weld-on adapter for cast tip;

9*c* replaceable tip laminated angled tooth with weld-on adapter for cast tip;

FIG. 10 is an exploded view of a lip and tooth assembly with a laminated lip plate;

FIG. 11 is an exploded view of a laminated, combined lip and tooth plate assembly to be bolted to the side walls of the bucket assembly of FIGS. 3 and 4;

FIG. 12 is an exploded view of a front arch assembly for the bucket assembly of FIGS. 1 and 2 (welded);

FIG. 13 is an exploded view of a front arch for the bucket assembly of FIGS. 3 and 4 (bolted);

FIG. 14 is a partly exploded view of the bucket assembly of FIGS. 3 and 4 having a rear trunnion (bolted);

FIG. 15 is a pictorial view of the bucket assembly of FIGS. 1 to 4 with front and rear arches;

FIGS. 16 and 16*a* are pictorial views of the bucket assembly of FIG. 15 with front arch and two examples of rear side wall lifting points;

FIG. 17 is a pictorial view of the bucket assembly of FIGS. 1 to 4 with heavy duty side walls and welded front arch and trunnion;

FIG. 18 is a pictorial view of the bucket assembly of FIG. 17 with front and rear arch;

FIG. 19 is a pictorial view of the bucket assembly of FIG. 17 with heavy duty side walls and front arch and back side wall lifting points.

Figure 20:
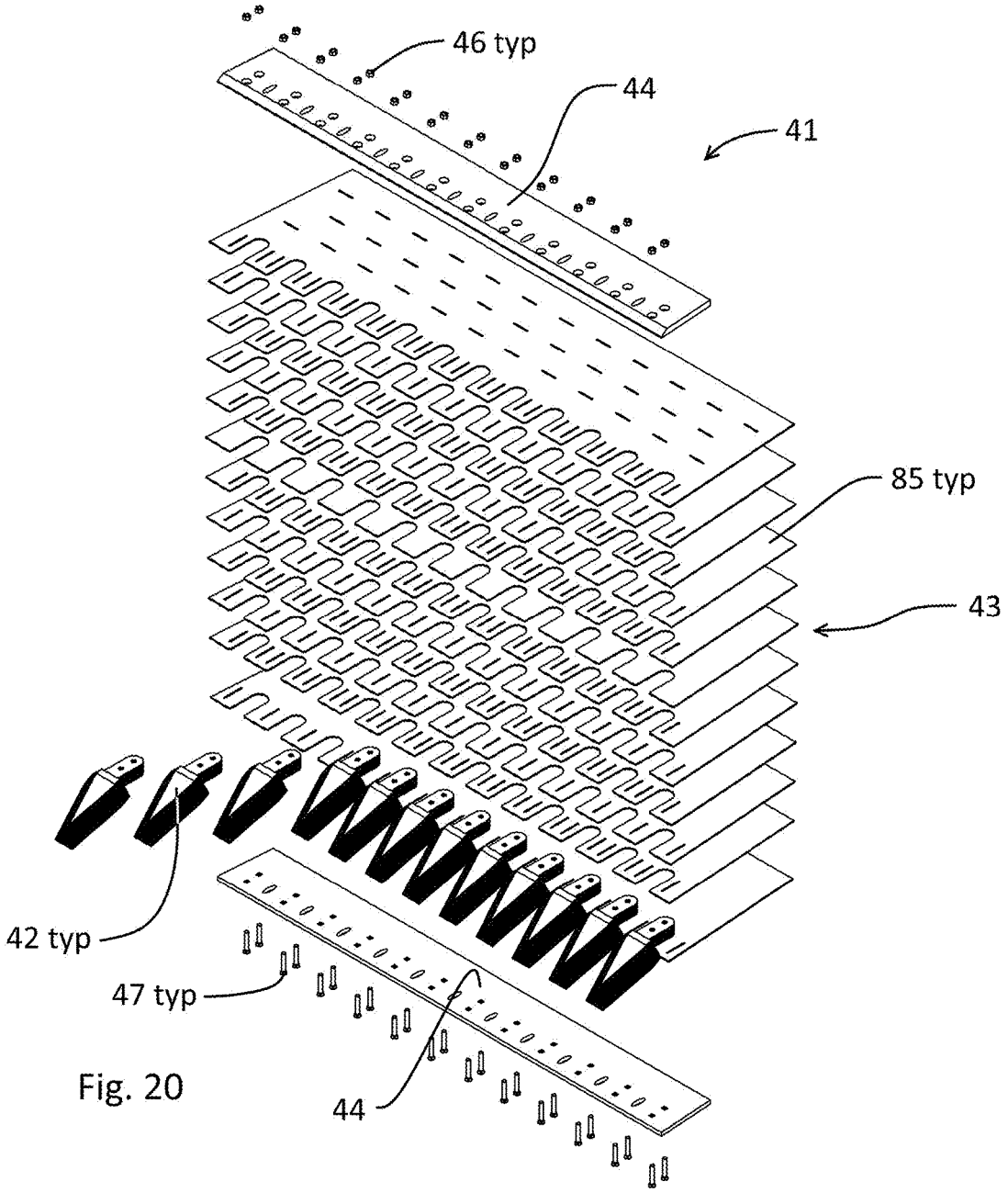

FIG. 20 is an exploded view of a laminated lip and tooth assembly.

Figure 21:
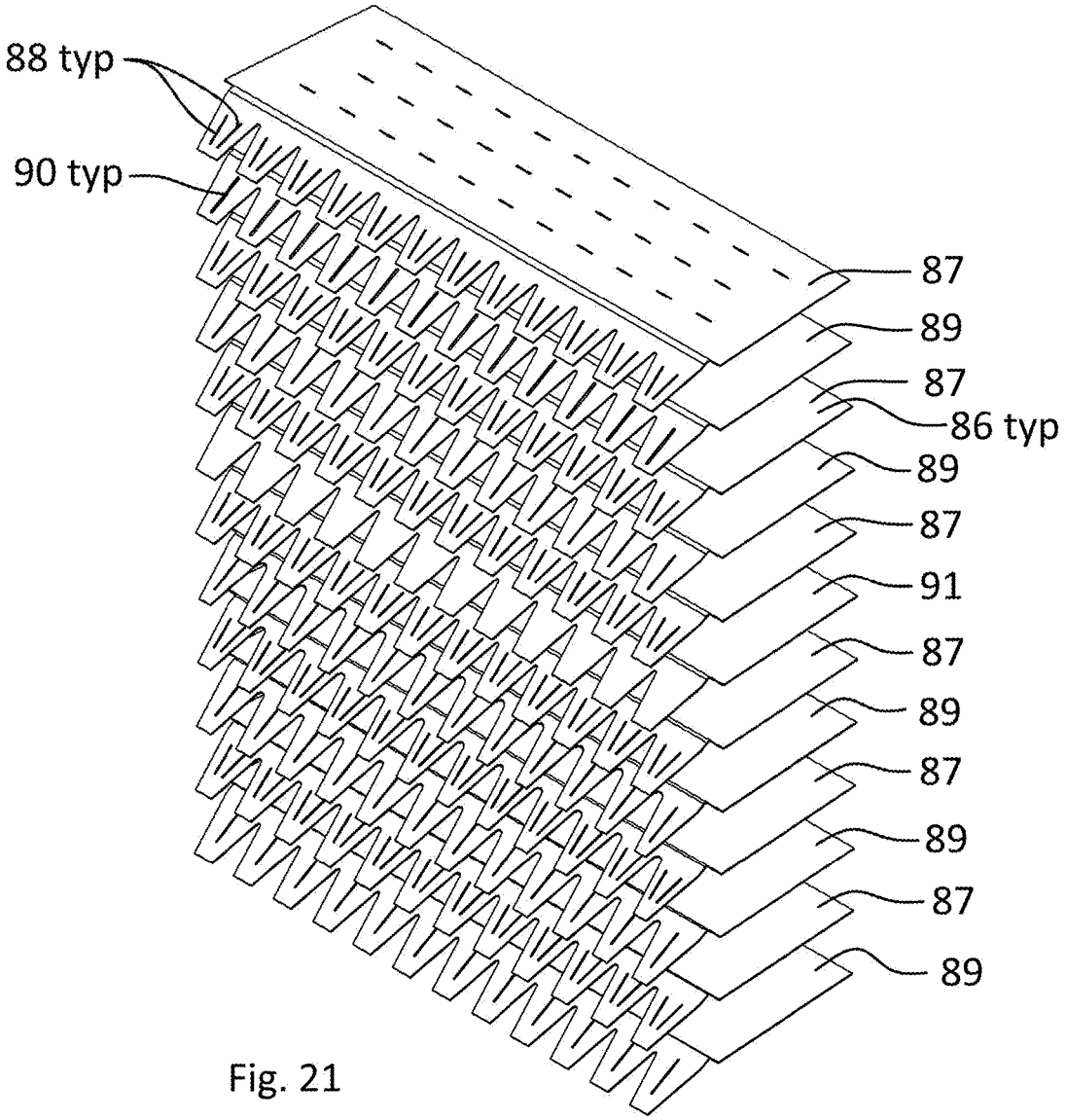
Figure 22:
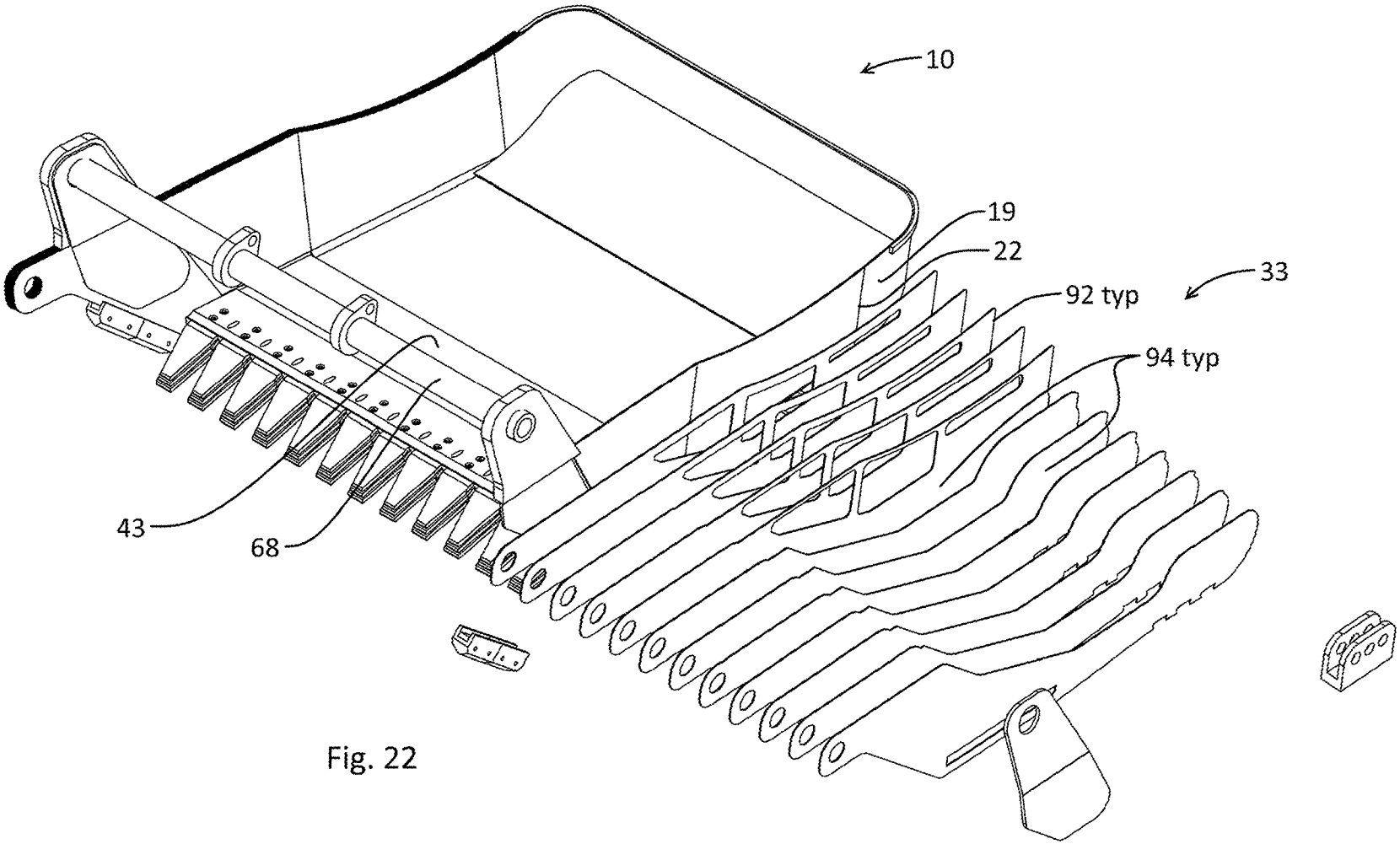
Figure 23:
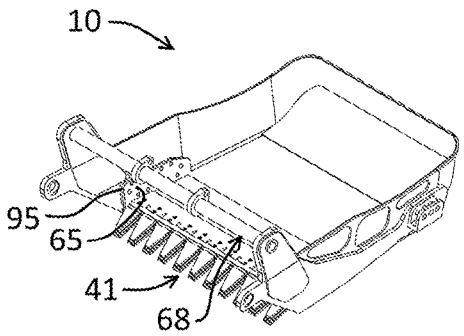
Figure 24:
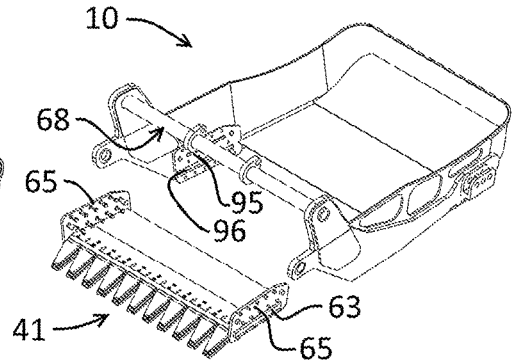
Figure 25:
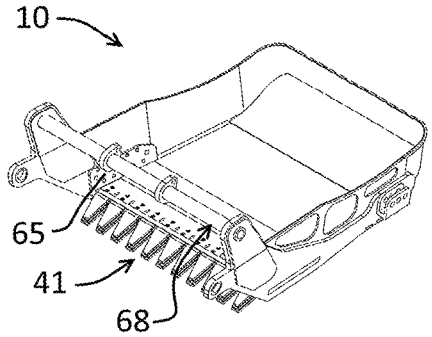
Figure 26:
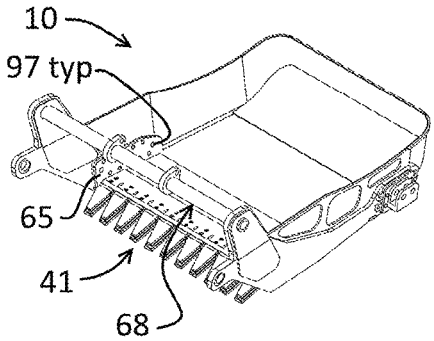
Figure 27:
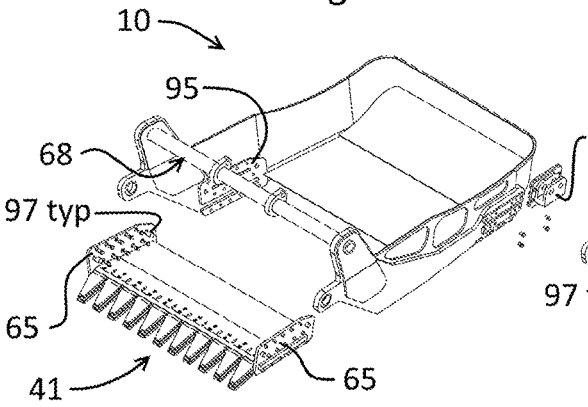
Figure 28:
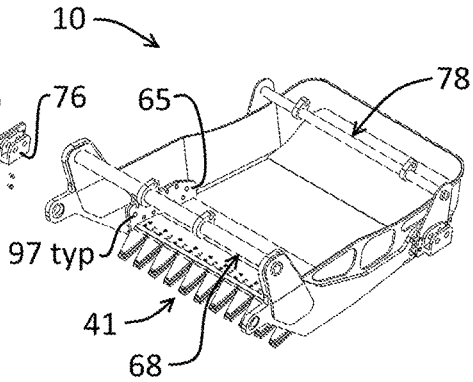
Figure 29:
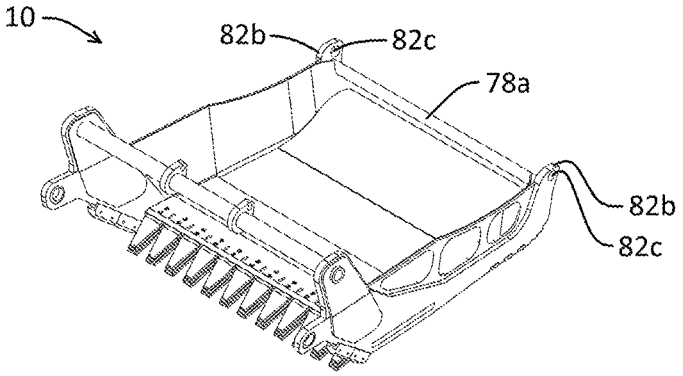
Figure 30:
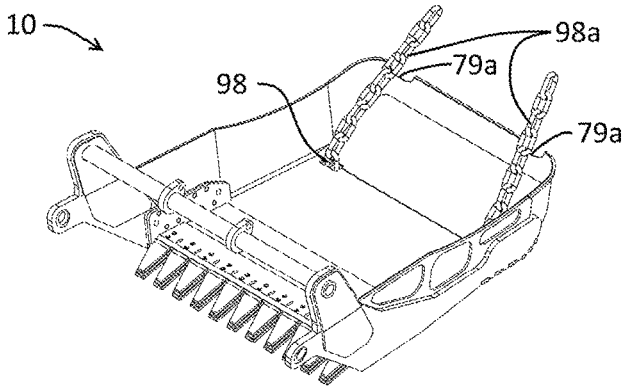
Figure 31:
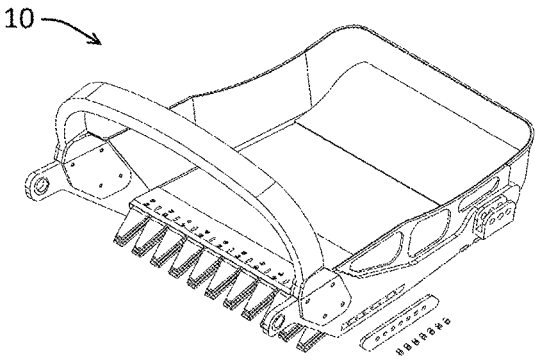
Figure 32:
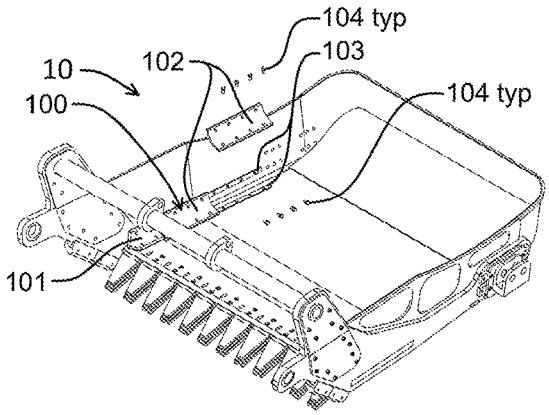

FIG. 21 is an exploded view of a laminated, thin plate, combined lip and tooth plate;

FIG. 22 is a partly exploded view of the bucket assembly of FIGS. 3 and 4 with side walls or chassis fabricated from laminated thin plate;

FIG. 23 is a pictorial view of the bucket assembly of FIGS. 1 to 4 with the lip bolted to chassis wall, lip end plates welded to lip and bolted to the chassis side wall;

FIG. 24 is an exploded view of the bucket assembly of FIG. 23;

FIG. 25 is a pictorial view of the bucket assembly of FIGS. 1 to 4 with a wide lip welded to end plates bolted directly to the chassis wall;

FIG. 26 is a pictorial view of the bucket assembly of FIGS. 1 to 4 with a bolted lip with dowels and a bolted trunnion;

FIG. 27 is an exploded view of the bucket assembly of FIG. 26;

FIG. 28 is a pictorial view of the bucket assembly of FIGS. 1 to 4 with a bolted lip with dowels and a rear arch connected to a bolted trunnion;

FIG. 29 is a pictorial view of the bucket assembly of FIGS. 1 to 4 with side wall lift points in line with the back wall and a stiffening arch/circular hollow section, in line with the back wall;

FIG. 30 is a pictorial view of the bucket assembly of FIGS. 1 to 4 with floor lift points in the rear and cut-outs in the back wall to allow for chains and/or rigging;

FIG. 31 is a pictorial view of a bucket assembly similar to that of FIGS. 1 to 4, but having a curved arch; and FIG. 32 is a pictorial view of a bucket assembly similar to that of FIGS. 1 to 4 and including a gusset.

DETAILED DESCRIPTION OF THE INVENTION

The bucket assemblies 10 illustrated in FIGS. 1 to 4, 14 to 19 and 22 to 28 all have features in common but include some different features as described hereinafter. In order to avoid cluttering of the drawings, the reference numerals for each feature are not necessarily included on each drawing. The absence of a reference numeral from a drawing is not to be taken that such a feature is absent from the bucket assembly illustrated in the drawing.

Each of the bucket assemblies includes a floor 11, a left side wall 12 extending upward from a left side 14 of the floor and a right side wall 13 extending upward from a right side 15 of the floor. The bucket assembly also includes a rear wall 16 having a main portion 17, a left hand end portion 18 extending from the left hand side of the main portion and a right hand end portion 19 extending from the right hand side of the main portion.

The rear wall extends upward from the plane of the floor, having a lower periphery 25 spaced from the rear periphery 20 of floor. The left hand portion is joined to the left side wall at a left hand join 21 and the right hand portion is joined to the right hand wall at a right hand join 22. The left and right hand portions together constitute end portions of the rear wall which curve around from the main portion of the rear wall to align with the respective side walls, thereby providing a right hand curve portion 23 and a left hand curved portion 24 such that the end portions extend upward from part of the right and left sides of the floor.

A sloping floor wall 26 is interposed between the rear wall and the floor having a lower front end 27 joined to the floor forward of the rear periphery of the floor and an upper back end 28 joined to the rear wall intermediate the upper and lower peripheries of the rear wall. The upper face of the sloping wall has a concave lower portion 29 and a convex upper portion 30. A reinforcing strip 31 is provided all the way along the upper periphery of the rear wall.

Each of the lateral side walls 12, 13 of the bucket assembly 10 includes a chassis plate assembly 33 for reinforcement. Each chassis plate assembly 33 includes an open frame plate 34 and a main chassis plate 35. An arch plate 36 is mounted to or affixed to the main chassis plate 35. In one embodiment, the arch plate 36 has an upper part 37 and a lower part 38 welded to the main chassis plate 35. A slot 40 is provided in the lower front region of the chassis plate assembly 33, the purpose of which is to receive an end of a lip plate assembly 41.

The main difference between the bucket assembly illustrated in FIGS. 1 and 2 and the bucket assembly illustrated in FIGS. 3 and 4 is that the arch plates 36 are welded to the chassis in FIGS. 1 and 2, whereas the arch plates are bolted to the chassis in FIGS. 3 and 4. In the bolted form, the arch plates can be mounted at different positions along the chassis.

A lip plate assembly 41 is mounted to the front end of the floor and has a plurality of tooth assemblies shown typically at 42 in regularly spaced intervals mounted thereto to project forward and downward from the floor. The tooth assemblies 42 are held in the lip plate assembly 41 by a lip plate 43 and a retaining plate 44.

Figure 5:
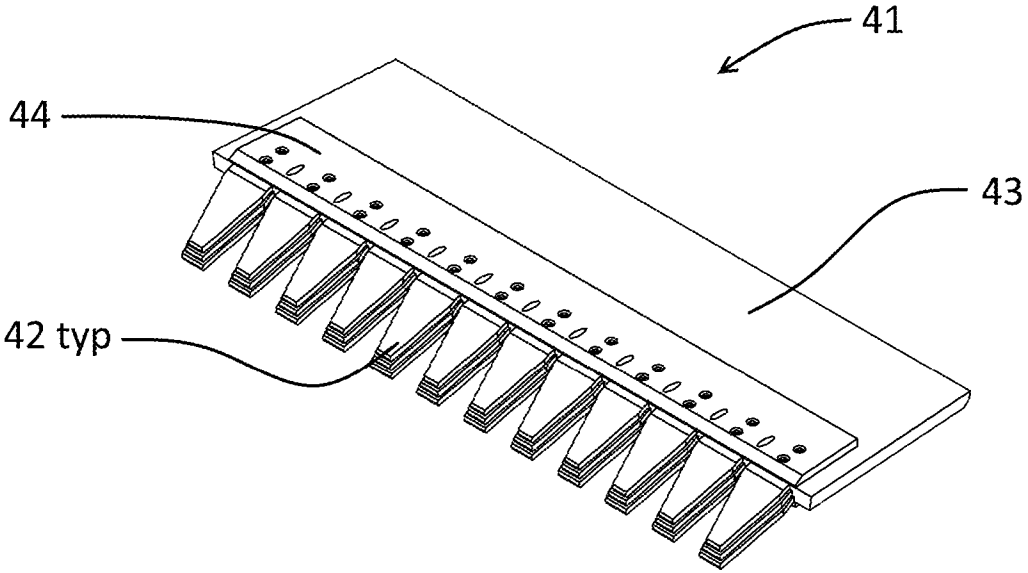
FIG. 5 is a pictorial view of a lip and tooth assembly for the bucket assembly of FIGS. 1 to 4.
Figure 6:
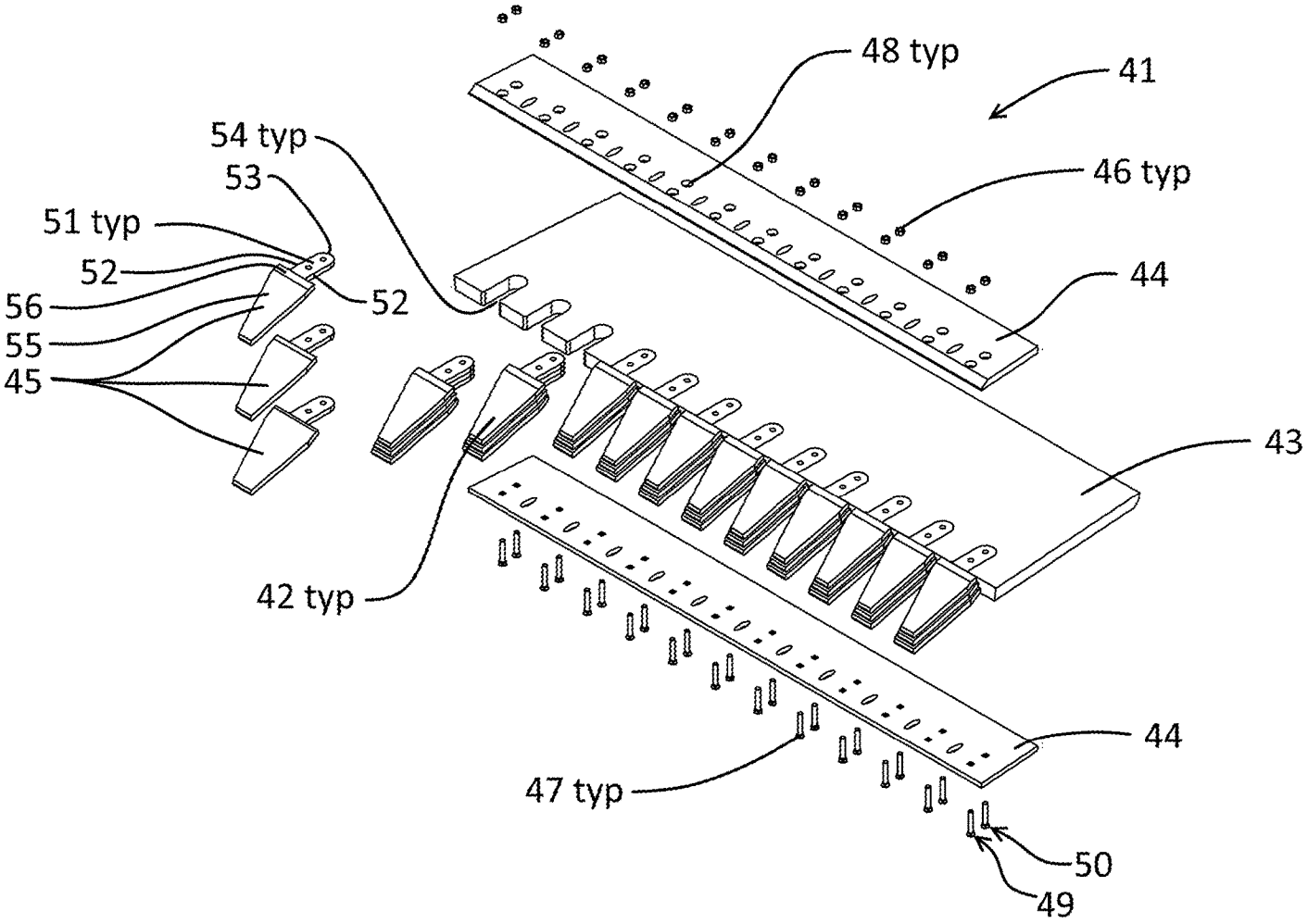
FIG. 6 is an exploded view of the lip and tooth assembly of FIG. 5.

The lip plate assembly 41 is described in more detail and with various options in 5 to 11. In FIG. 6, an exploded view of a three-piece laminate tooth assembly is shown, the tooth assembly being constituted by three tooth plates at 45. It will be appreciated that other combinations of plates may be used. Each tooth plate 45 is substantially symmetrical about a tooth axis running substantially in the intended direction of travel of the bucket assembly during the scooping part of the operational cycle. In the exploded view there can be seen a plurality of nuts and bolts typically at 46 and 47 respectively are shown for retaining the retaining plates and tooth assemblies in position. It will be appreciated that although the nuts and bolts are illustrated in FIG. 5, they are more easily seen in the exploded view of FIG. 6. Additionally, it can be seen that the shanks of the bolts pass through corresponding apertures shown typically at 48 which penetrate through the tooth assemblies and the retaining plates.

The apertures are provided in two sets, a forward set 49 and a rearward set 50, the members of each set forming pairs across the length of the lip plate assembly and the width of the bucket assembly. A pair of apertures is provided through each tooth plate in alignment with the tooth axis for mechanical stability of the tooth assembly, the apertures through the tooth plates being aligned with those through the retaining plates. A pair of apertures is preferred, but it will be appreciated that a single aperture would be sufficient.

Each tooth plate 45 has a rearward projecting tongue 51 through which the apertures pass. The tongue has substantially parallel sides 52 and a rounded end 53 which correspond to the shape of respective cremations shown typically at 54 along the forward extremity of the lip plate 43 to keep the tooth assemblies in substantial alignment. It can also be seen that each tooth plate 45 has a trapezoidal forward part 55 from which the tongue projects rearwardly, the trapezoidal forward part being angled downward from the tongue and having its shorter side forward and below its longer side.

Each of the three tooth plates bends from different location, the lower one of the tooth plates bending from the tongue, the intermediate one bending from slight forward of the tongue and the upper one bending further forward of the tongue. Accordingly, the upper two tooth plates include a rectangular portion 56 in substantial planar alignment with the tongue. Each tooth plate may be formed from different type of material, the material being selected for characteristics suited to the application and relation to, and in conjunction with, the other tooth plates.

Figures 7A, 7B, 7C:
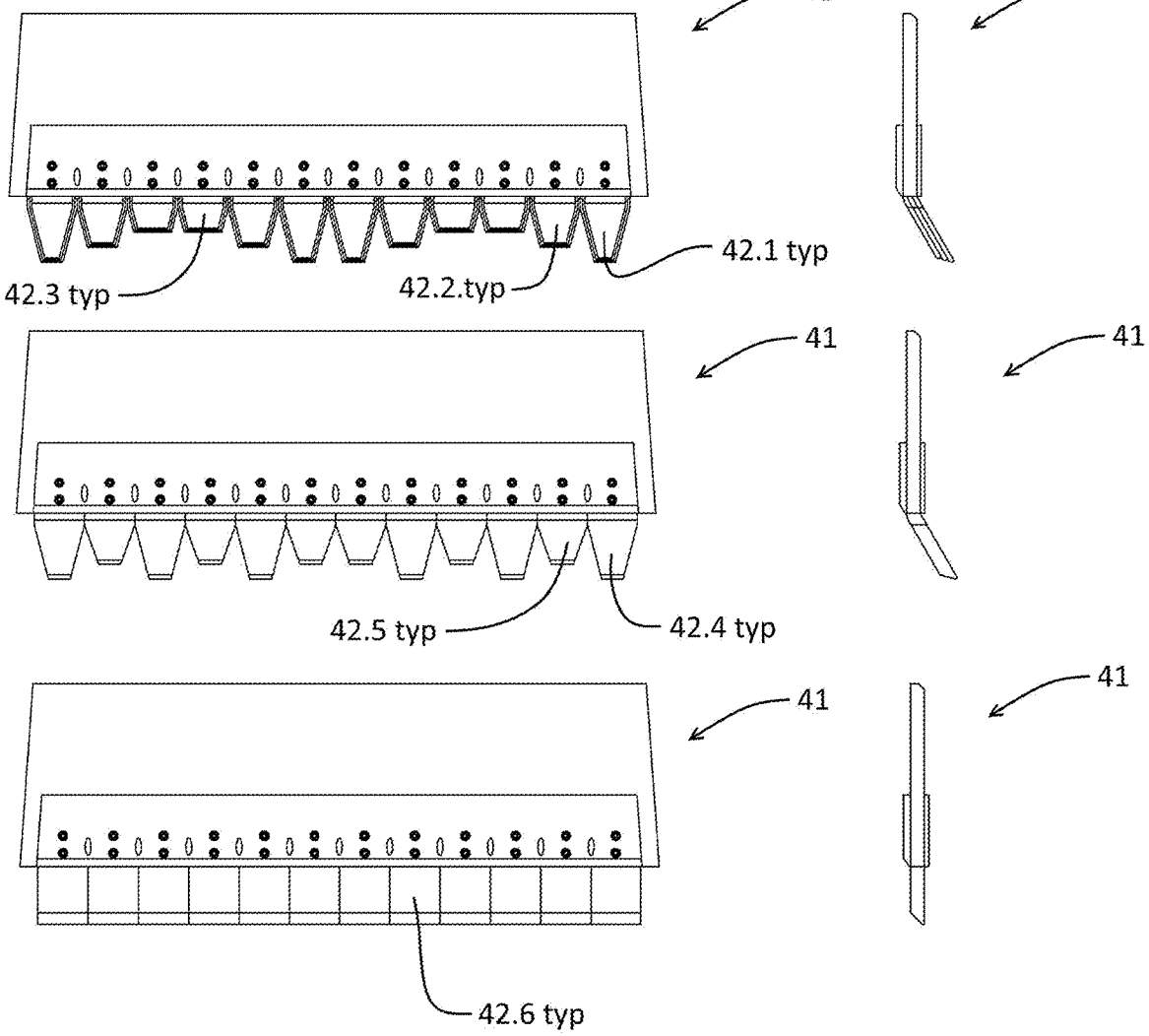
FIGS. 7*a* to 7*c*, 8*a* to 8*c*, and 9*a* to 9*c* collectively show in nine orthographic projections the plan and end views of tooth and ground-engaging-tool (GET) options, being.

Several alternative tooth configurations may be provided as shown in FIGS. 7*a* to 7*c*, 8*a* to 8*c*, and 9*a* to 9*c*. The laminated angled teeth (serrated) are provided in longer lengths as illustrated in FIG. 7*a* typically at 42.1, intermediate lengths as illustrated typically at 42.2 and shorter lengths as illustrated typically at 42.3. It can be seen that the longer intermediate length teeth are interposed between a longer length tooth and a shorter length tooth such that the longer lengths are at the outer ends and in the centre. The solid angled teeth (fabricated or cast; serrated) are provided in longer lengths as illustrated in FIG. 7*b* typically at 42.4 and in shorter lengths as illustrated typically at 42.5, alternating between longer lengths and shorter lengths with longer lengths at the outer ends and shorter lengths adjacent one another in the centre. The solid flat teeth (plate; straight edge—suited for chop cutting) illustrated in FIG. 7*c* are illustrated typically at 42.6 and are each of substantially the same length all of the way across the width of the tooth assembly.

Figures 8A, 8B, 8C:
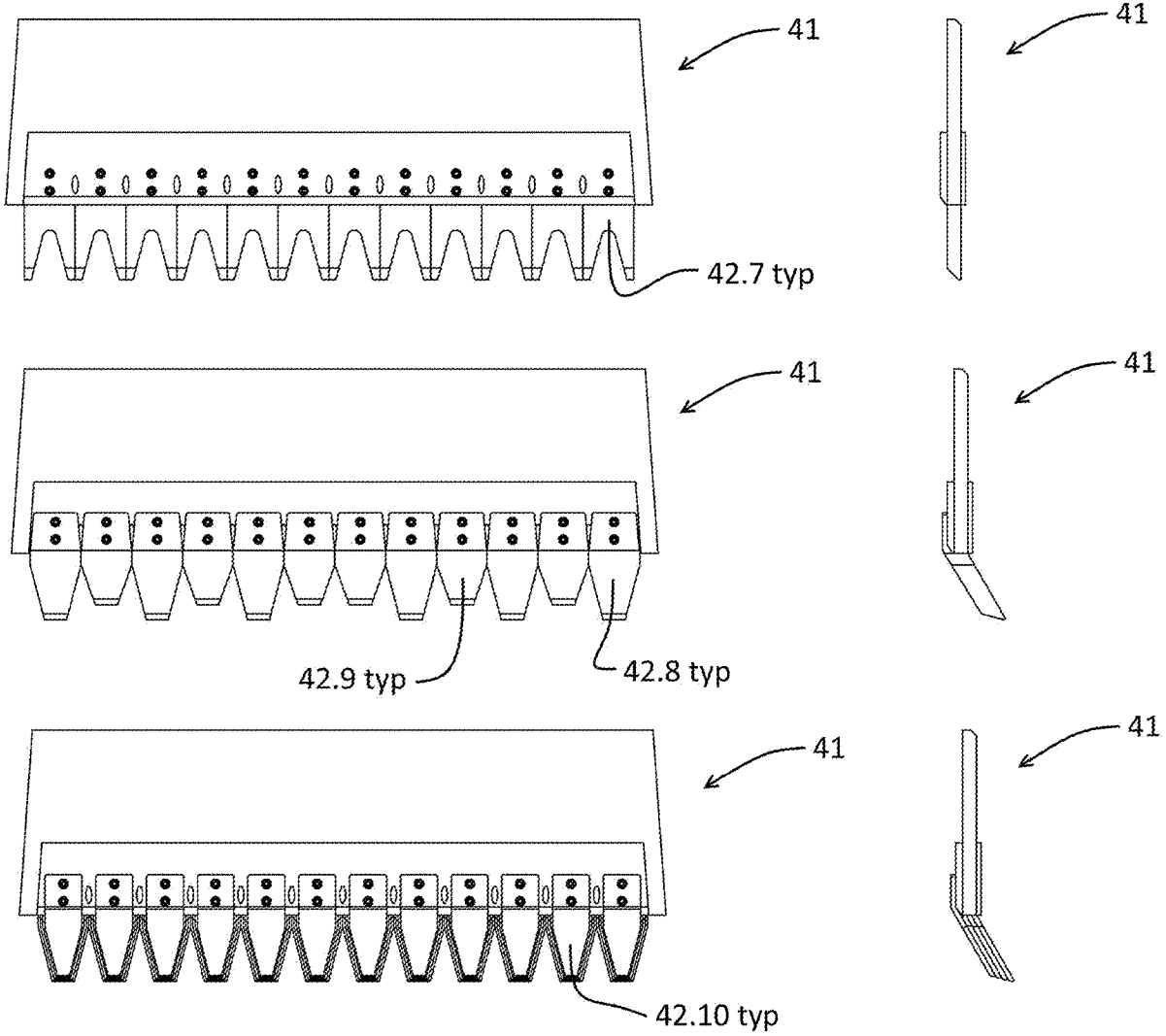

The tiger tooth option—2 points per tooth illustrated in FIG. 8*a* is shown typically at 42.7. The solid angled teeth (cast) with top face shroud of FIG. 8*b* are provided in a longer form as illustrated typically at 42.8 and in a shorter form as illustrated typically at 42.9, alternating between the longer and shorter forms along the length of the tooth assembly with the longer form at the outer ends and two shorter forms adjacent one another in the centre. The laminated angled teeth with top face shroud are illustrated in FIG. 8*c* typically at 42.10.

Figure 9A:
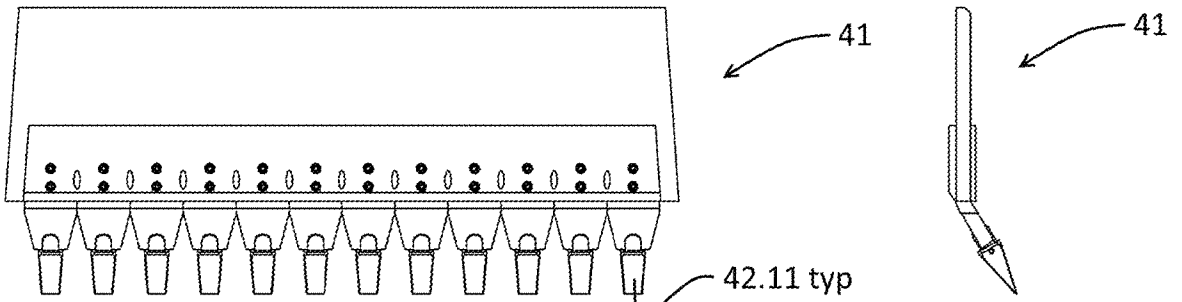
Figure 9B:
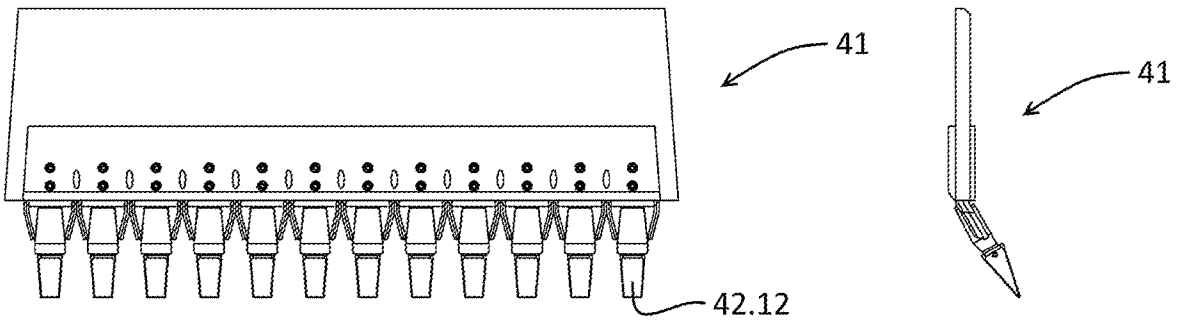
Figure 9C:
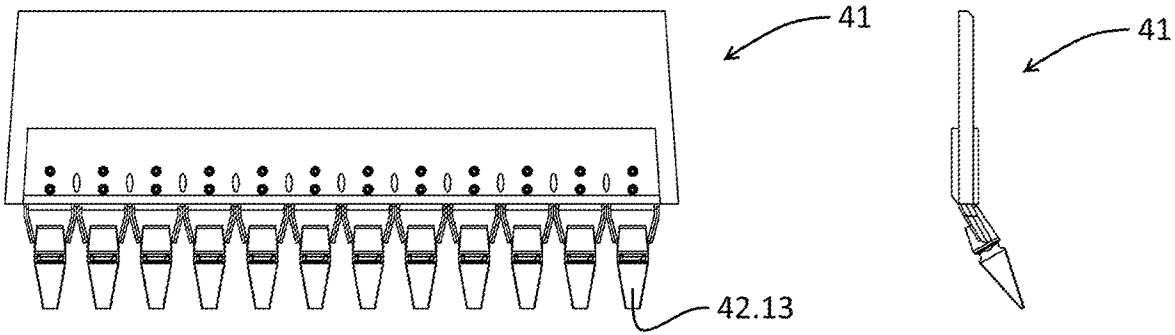

The replaceable tip solid angled tooth, fabricated or cast, with cast tip of FIG. 9*a* is illustrated typically at 42.11. The replaceable tip laminated angled tooth with weld-on adapter for cast side pin tip of FIG. 9*b* is illustrated typically at 42.12. The replaceable tip laminated angled tooth with weld-on adapter for cast tip of FIG. 9*c* is illustrated typically at 42.13.

The lip plate assembly 41 illustrated in FIG. 10 has a laminated lip plate having a central plate 57 and an outer plate 58 mounted on either side of the central plate. The retaining plates 44 are mounted to the opposed outer faces of the outer plates and the assembly, together with the tooth assemblies, is fastened together by nuts and bolts as hereinbefore described. The teeth or tooth assemblies may be retained with pins and locks if desired.

The laminated, combined lip and tooth plate assembly illustrated in FIG. 11 includes a central lip and tooth assembly 60 disposed between an upper lip plate assembly 61 and a lower lip plate assembly 62, the lip plates to which the teeth being mounted having end portions 63 extending beyond the outside of the end tooth or tooth assemblies. The end portions are so formed and arranged that in the assembled condition, each one is inserted into a slot 64 provided in a side plate 65 and welded into place. This arrangement permits the combined lip and tooth plate assembly to be bolted to the side walls or side chassis of the bucket assembly of FIGS. 3 and 4. It can also be seen that the trapezoidal portions of the teeth have triangular apertures shown typically at 66 penetrating therethrough for welding to each lip layer.

The front arch assembly 67 illustrated in FIGS. 12 and 13 includes a front arch bar 68 extending between two front arch plates 69 through a front aperture 70. A trunnion 39 is mounted to the upper part of the arch plate or formed by protrusion of the arch bar through the arch plate. The arch plates are each mounted to a chassis plate 33 and are comprised of three plates, a main plate 71 and two additional plates 72 on each side thereof. The front face of each chassis plate has one or more wear part assemblies 73 mounted thereto. The difference between the front arch assembly of FIG. 12 and that of FIG. 13 is that the front arch assembly illustrated in FIG. 12 is welded together whereas the front arch assembly illustrated in FIG. 13 is bolted together by nuts and bolts shown typically at 74 and 75 respectively.

Options for the bucket assembly according to the invention as illustrated in FIGS. 14 to 19 are now described as follows. The bucket assembly of FIG. 14 has a rear trunnion 76 bolted to a rear trunnion mounting formation 77 mounted or attached to the outer face of the chassis plate. The bucket assembly of FIGS. 15 and 16 has the front arch as hereinbefore described and a rear arch 78. In the case of the bucket assembly of FIG. 15, there are two notches 79 provided in the upper extremity of the rear wall to accommodate a chain fixed to the rear fixing points 80 on the rear arch. There are two forward lifting points 81 on the forward arch. The bucket assembly of FIG. 15 is the same as that of FIG. 16 except that two back side wall lifting points 82 are provided instead of the rear lifting points. The bucket assembly of FIG. 16*a* is the same as that of FIG. 16 except that the two backside lifting points 82*a* are provided at or rearward of the rear corner instead of being forward thereof and the rear wall has a lower upper perimeter, and a lower rear arch bar 89 permitting the bucket to operate under a universal dig and dump operating sequence.

The bucket assembly of FIGS. 17, 18 and 19 is provided with heavy duty side walls 83 and a welded front arch and trunnion 84. The bucket assembly of FIG. 18 is provided also with the rear arch as hereinbefore described with reference to FIG. 15. The bucket assembly of FIG. 19 has the back side wall lifting points as hereinbefore described with reference to FIG. 16.

The lip plate assembly of FIG. 20 is of lamellar form, also described herein as "laminated", has the lip plate 43 made up from twelve thin plates shown typically at 85, each having substantially the same configuration. The lip plate assembly is shown with teeth also fabricated from multiple thin plates. The assembly is held together with the nuts and bolts as hereinbefore described together with the retaining plates 44 as hereinbefore described.

The lip plate assembly illustrated in FIG. 21 has twelve plate-like lip plates each combined with twelve plate-like teeth, each lip plate and its teeth being integrally formed as shown typically at 86. The first, third, fifth, seventh, ninth and eleventh plates 87, counted from the top, each have a pair of grooves or slits shown typically at 88 running part way along and spaced inward from the trapezoidal sides of each tooth to facilitate joining the plated together by welding. The second, fourth, eighth, tenth and twelfth plates each have a single groove or slit shown typically at 90 running part way along the centerline of each tooth. The sixth plate 91 does not have any grooves or slits in the teeth.

In the bucket assembly illustrated in FIG. 22, the chassis plates 33 are made up from twelve thin plates, the five closer to the side wall being frame plates shown typically at 92 each having an open framework portion 93 and a body portion 94 and the remainder not having the open framework portion, just the body portion as illustrated.

The bucket assembly of FIGS. 23 and 24 has the lip bolted to the chassis wall by way of two lip end plates, referred to herein as side plates, welded to the lip assembly and bolted to the chassis wall by way of a chassis wall plate 95. It can be seen that the outwardly projecting end portions 63 match up with a slot 96 in the chassis wall plate. The bucket assembly of FIG. 25 shows a similar arrangement, but with a wide lip welded to end plates bolted directly to the chassis wall, that is, without the chassis wall plate of FIGS. 23 and 24.

The bucket assembly of FIGS. 26 and 27 has an arrangement similar to that of the bucket assembly FIGS. 23 and 24, but also has four dowels shown typically at 97 for aligning the end plates to the chassis wall plate. The bucket assembly also has a bolted rear trunnion 76 bolted to each chassis plate. IT can be seen that a slot or dovetail arrangement is provided for mounting the rear trunnion to the side of the bucket assembly, the slots running substantially parallel to the direction of travel of the bucket assembly when being dragged in the fill part of its operational cycle. The bucket assembly of FIG. 28 is the same as that of FIGS. 26 and 27 except that there is also provided a rear arch connected to the bolted trunnion.

The bucket assembly of FIG. 29 has two rear lift points 82*b* having a circular apertures 82*c* aligned coaxially with one another such that the common axis is rearward of the back wall. The bucket assembly also has a stiffening arch or hollow section 78*a* also in line with the back wall. The bucket assembly of FIG. 30 has two floor lift points 98 at the rear of the floor immediately forward of the sloping wall. The lifting points each provide for the attachment of a chain 98*a*, there also being cut-outs in the top edge of the back wall at 79*a* to allow for the chains or for rigging. The bucket assembly of FIG. 31 has a core lip plate 43*a* having threaded apertures shown typically at 43*b*. A modified side plate 65*a* has counterbored apertures shown typically at 65*b* aligned with the threaded apertures in the end faces of the lip plate for receiving bolts shown typically at 65*c* for bolting the side plate to the remainder of the bucket assembly. The bucket assembly of FIG. 31 also has a curved arch 99, being illustrated as such for the purpose of showing that the form of the arch may be selected according to the application and cost factors.

The bucket assembly illustrated in FIG. 32 is the same in most respects as that illustrated in FIGS. 1 to 4. However, a gusset assembly 100 is fixed or fastened to each side of the floor where the side walls meet the floor, only one being shown because the other is hidden from view by the side wall. Each gusset assembly has a gusset transition member 101 fixed at, on or close to, but behind, the front edge providing a transition from a sharp to a curved inside corner. Two further gusset pieces 102 are mounted, fixed or fastened in position behind the gusset transition member. A mounting strip 103 is interposed between the gusset pieces and the floor and side walls to that bolting does not distort the gusset pieces when fastened tightly in place by a plurality of bolts shown typically at 104.

In use, the bucket assembly according to the invention may be partly fabricated off site, such as in a factory or foundry, the plates to be used in forming the bucket assembly being packed for shipment prior to assembly into its final form. Such an arrangement may be considered to be somewhat akin to a "flat pack" arrangement, the parts being welded and/or bolted together to form the bucket assembly on site, such as a mine site.

The lip assembly incorporated into the bucket assembly according to the invention has several advantages in and of itself independently of the remainder of the bucket assembly according to the invention. In particular, the teeth or tooth assemblies may be removed and replaced and may have hardfacing and materials options incorporated therein, and may be varied in form and/or arrangement to accommodate different digging conditions. It will be appreciated that bucket assembly according to the present invention is not confined or limited to the specific arrangements of optional elements or features as illustrated. In particular, the elements or features may be mixed and matched to provide different combinations. For example, the curved arch of FIG. 31 may be used in any one of the other bucket assemblies illustrated, or the arch illustrated in the other figures may be used in the bucket assembly illustrated in FIG. 31 instead of the curved one.

Although the invention has been described with reference to several specific examples, it will be appreciated by persons skilled in the art that the invention may be embodied in other forms within the broad scope and ambit of the invention as herein set forth and defined by the following claims.

I claim:

1. A dragline bucket assembly including:

a cutting edge including a lip and a plurality of teeth attachable to the lip;

a floor extending rearward from the cutting edge and having a periphery and a plurality of side walls extending upward from a part of the periphery to extend about the floor from one end of the cutting edge to the other;

the plurality of side walls comprising a rear wall intermediate two lateral side walls, each lateral side wall extending upward from one side of the floor; and a chassis formed from one or more single-piece chassis rails each extending from the cutting edge to the rear wall, the chassis being attachable to each lateral side wall, and the lip being attachable to the chassis by bolting or by bolting and welding.

2. The dragline bucket assembly according to claim 1, wherein the lip is mechanically attachable to the floor as well as the side walls.

3. The dragline bucket assembly according to claim 1, wherein the lip is in the form of a lip assembly including a capping plate and a bottom plate for retaining the plurality of teeth.

4. The dragline bucket assembly according to claim 1, wherein the lip and plurality of teeth are provided in the form of a laminated tooth assembly including:

a plurality of lip plates of complementary form which may be fastened or welded to one another to provide layers, the plurality of teeth being fastened to the lip plate.

* * * * *